US005736843A

United States Patent [19]

Amin

[11] Patent Number: 5,736,843

[45] Date of Patent: Apr. 7, 1998

[54] EFFICIENT ULTRA LOW DROP OUT POWER REGULATOR

[75] Inventor: Dilip A. Amin, San Jose, Calif.

[73] Assignee: Silicon Graphics, Inc., Mountain View, Calif.

[21] Appl. No.: 431,704

[22] Filed: Apr. 27, 1995

[51] Int. Cl.[6] ..... G05F 1/56

[52] U.S. Cl. ..... 323/273; 323/282

[58] Field of Search ..... 323/273, 274, 323/282, 284, 303

[56] References Cited

U.S. PATENT DOCUMENTS

| | | | |
|---|---|---|---|
| 4,327,319 | 4/1982 | Swisher et al. | 323/303 |
| 4,543,522 | 9/1985 | Moreau | 323/303 |
| 4,906,913 | 3/1990 | Stanojevic | 323/303 |
| 4,928,056 | 5/1990 | Pease | 323/314 |
| 5,036,269 | 7/1991 | Murari et al. | 323/266 |
| 5,280,233 | 1/1994 | Poletto et al. | 323/269 |
| 5,373,225 | 12/1994 | Poletto | 323/282 |
| 5,510,697 | 4/1996 | Dormer | 323/273 |

OTHER PUBLICATIONS

Notification of Transmittal of The international search Report or the Declaration Mailed: Aug. 14, 1996 International Application No.: PCT/US96/05710.

*Primary Examiner*—Matthew V. Nguyen

*Attorney, Agent, or Firm*—Blakely, Sokoloff, Taylor & Zafman

[57] ABSTRACT

An ultra low drop out power regulator is described. The power regulator may be used, for example, where a dynamically fast, and electrically clean power supply at the point of use is required. The power regulator is provided as a single part with two input voltages. The higher voltage input drive the output stage so that ultra low drop out is achieved. The disclosed regulator is therefore more efficient, resulting in less heat dissipation. The regulator is packaged in a stand up package thereby reducing board space. By use of a stand up package, air flow to other components is not blocked.

22 Claims, 3 Drawing Sheets

EFFICIENT ULTRA LOW DROP OUT POWER REGULATOR

BACKGROUND OF THE INVENTION

1. Field of the Invention

The present invention relates to computer systems, and more specifically to a device for supplying power to one or more components in the computer system.

2. Background Information

Computer systems may comprise numerous devices or components, which may be coupled together in a variety of ways. For example, various devices such as integrated circuits, as well as various discrete components, such as diodes, transistors, resistors, etc., may be packaged in a variety of ways in packages having pins which coupled to a printed circuit board (pcb). The pcb comprises wiring to interconnect various devices, as appropriate, and may additionally have various devices or circuits built in. In addition to packages with pins, devices may be coupled to the pcb directly by, e.g., surface mount technology. Additionally, other types of systems, such as multi-chip modules, for example, are known.

In various computer systems, several input voltages, such as, for example, 12.0 volts (V), 5.0 V, and 3.3 V, may be provided. It will be appreciated that the voltage supplied in a system is not limited to these values, but may comprise different or additional voltage values, and may comprise negative voltage values. Referring to FIG. 1, the system may be supplied with alternating current (ac) power source 100. Then, system power supply 101 converts, rectifies, and regulates the ac power to provide direct current (dc) power to the system. The power supply 101 may supply power at one or more different voltage levels. Additionally, power supply 101 typically provides a ground connection. It will be appreciated that the system may comprises more than one power supply 101, each providing one or more different voltage levels. In any event, many systems provide two or more different voltages. Often, the power from power supply 101 is not suitable to be coupled directly to the device using the power (the load), but must first go through other circuits and devices to be further filtered, regulated, etc. For example, the load, represented by box 103, may be the termination power provided to the termination lines to the high speed bus lines between, for example, a microprocessor 104 and memory device 105. The regulator 102 typically drops the voltage down to the appropriate level, for example 2.4 V. Currently, available regulators 102 are designed for a devices that may operate at frequencies typically from 20–60 megahertz (MHz) or more.

While various devices are known for providing a regulated voltage supply, these devices are inadequate for current and future devices having even higher speeds, for example, in the range of approximately 100–400 MHz. Thus, the power regulator must be dynamically fast since the load switches from no load to 100% load at these high frequencies. A further requirement is that the power needs to be noise free ("electrically clean"). In addition, because of these high speeds, it is desirable to keep the power supply as near the point of load on the circuit board as possible.

FIG. 2 illustrates a circuit diagram of a prior art low drop out power regulator 102. Input 210 is coupled to the system's voltage source, such as a five volt supply. Output 211 is coupled to, for example, load 103 which may be a high speed termination line. Load 103 is further coupled to return path 205 at connection 213. Control circuit 230 controls the output voltage at output 211. As shown, input 210 is coupled to the emitter of transistor 201, and, via node 225 and resistor 202, to the base of transistor 201. Additionally, as shown, node 212 is coupled through resistor 203 to return path 205 at node 214. Further as shown, the collector of transistor 201 is coupled to output 211. In this circuit, the output stage, which comprises transistor 201, is driven by input 210 through resistor 202. Note that because there is a voltage drop through resistor 202, the voltage driving the base of 201 is necessarily lower than the input voltage at the emitter of transistor 201. In a typical prior art regulator 102, the drop out voltage between input 210 and output 211 is approximately 1.0. If a 2.4 V potential at output 211 is desired, a five volt supply coupled to input 210 has the necessary differential (5.0 V−1.6 V=3.4 V) to drive the circuit, but is highly inefficient since the large input 210/output 211 differential (5.0 V−2.4 V=2.6 V) leads to a high power loss. A 3.3 V supply, on the other hand, would result in far less power loss, but has an insufficient differential (3.3 V−2.4 V=0.9 V) to drive the circuit of FIG. 2 since the drop out of approximately 1.0 V is larger than the input/output differential of 0.9 V. In addition, since both the input voltage and output voltage have a margin of approximately ±5%, the situation is worse when the margin is low on the 3.3 V supply (i.e., approximately 3.15 V), and high on the 2.4 V output (i.e., approximately 2.55 V). In this case, the differential is equal to 3.15−2.55=0.6 V, and the circuit of FIG. 2 simply does not operate.

As mentioned above, a problem with the circuit of FIG. 2 is that it is relatively inefficient, which results in heat dissipation. Traditionally, the circuit of FIG. 2 has been packaged in a metal can package due to excess heat dissipation, such as a "TO-3" three pin metal package available from Linear Technology, Milpitas, Calif. This type of package allows for cooling of the excess heat. Referring to FIGS. 4A and 4B, an example of the TO-3 package 400 is shown. FIG. 4A shows a side view of package 400 while FIG. 4B shows a top view of package 400. Package 400 comprises a broad, metal cover 401, a base 402, and three pins 403. The base 402 is placed directly on the board, and consumes a large amount of board footprint. Additionally, this package blocks air flow, which may impact the cooling of nearby, sensitive high speed devices. It would be desirable to put the regulator in a stand up package (i.e., a package whose pins lift it off of the board), especially a single in-line package (SIP) such as a "TO-220" plastic package, also available from Linear Technology, which uses vertical space instead of board footprint, and does not block air flow. However, the circuit of FIG. 2 cannot be put in such a package because there would be insufficient heat dissipation as compared with that achieved with the metal TO-3 package. Other suppliers of regulators such as described in conjunction with FIG. 2 include Micrel Semiconductor of Milpitas, Calif. and Unitrode, of Merimack, N.H.

These issues are even more problematic with regard to the very high frequency devices described earlier, as these devices require, more than previous devices, that the power regulator be as close to the load as possible due to the high speed. Additionally, these devices are more sensitive to heat dissipation than prior devices.

One solution to this problem would be to use a two input voltage circuit with discrete components directly on the board. While this would reduce the amount of heat generated, it would require more board space, and cannot be as easily cooled as a packaged device. In addition, this approach would reduce flexibility since the on-board circuitry cannot be as easily changed due to the number of components. Additionally, such an approach would be more costly and less reliable due to the number of pieces required. Therefore, due to the board space, reliability, heat, and cost, this approach is not pursued.

A further solution to the heat problem is to put the appropriate circuitry on a stand up board of discrete components. This technology is often referred to as a switching regulator. Although this approach reduces heat, a charge pump circuit is required to generate a second voltage. However, this second voltage has a substantial amount of electrical noise, requiring filters and therefore taking up more board space. In addition, the switching regulator typically is slower by a factor of approximately two orders of magnitude or more than a linear regulator. Thus, this technology does not lend itself to increasingly faster microprocessors. To solve this problem a large capacitor is typically required. Although linear regulators also require a capacitor, it is typically much smaller than that required by a switching regulator.

Referring again to FIG. 2, as can be seen, the output stage 201 comprises a pnp transistor. One problem with the pnp transistor 201 is that it has a lower gain and lower bandwidth than a npn transistor. However, the pnp transistor 201 has typically been used because the gain and bandwidth of the regulator 102 has been satisfactory for prior art applications. In addition, use of an npn transistor for the output stage would be more costly, since such a circuit would additionally require a pnp transistor to drive the npn transistor. However, the circuit of FIG. 2 is not satisfactory where higher gain (for, e.g., small die size and lower heat) and higher bandwidth (for, e.g., high speed) is desired. Further, in the transistor 201, note that the drive current flows out the base of transistor 201 to return path 205, resulting in a loss of at least 10% of the power. This loss of the drive current lowers the efficiency of the circuit, adding to the heat problem. A further problem with the circuit of FIG. 2 is that it is only capable of providing power for relatively low power (e.g.,≦1 amp) applications.

Thus, as can be seen, a very efficient, low heat dissipation, single package, small footprint solution to providing voltages such as, for example, 2.4 V from 3.3 V, etc., is not currently available. Therefore, what is desired is a single part, ultra low drop out power regulator, having low heat dissipation, so that it is capable of being packaged in a stand up package. The device should be noise free, and dynamically fast so that it is capable of supplying power to, for example, current and future high speed devices. The device should be capable of providing a high power output, of, for example, 10 amps. Additionally, the circuit should desirably have a high gain and high bandwidth.

SUMMARY OF THE INVENTION

A single package ultra low drop out power regulator is described. The power regulator has a first input voltage and a second, higher input voltage. The first input voltage provides the power, and the second input voltage drives the output stage. In this way, a low drop out, highly efficient and therefore low heat dissipating device is produced. Because of the reduced heat dissipation, the device can be packaged in a stand up package, thereby reducing board space. Additionally, by virtue of the lower heat generation and stand up package, the regulator may be placed close to the load.

Additional features and benefits of the present invention will become apparent from the detailed description, figures, and claims set forth below.

BRIEF DESCRIPTION OF THE DRAWINGS

The present invention is illustrated by way of example and not limitation in the accompanying figures and in which.

DETAILED DESCRIPTION

An efficient, ultra low drop out power regulator is disclosed. In the following description, numerous specific details are set forth such as specific devices, specifications, input and output voltages, etc. in order to provide a thorough understanding of the present invention. It will be obvious, however, to one skilled in the art that these specific details need not be employed to practice the present invention. In other instances, well known materials or methods have not been described in detail in order to avoid unnecessarily obscuring the present invention.

Figure 3:
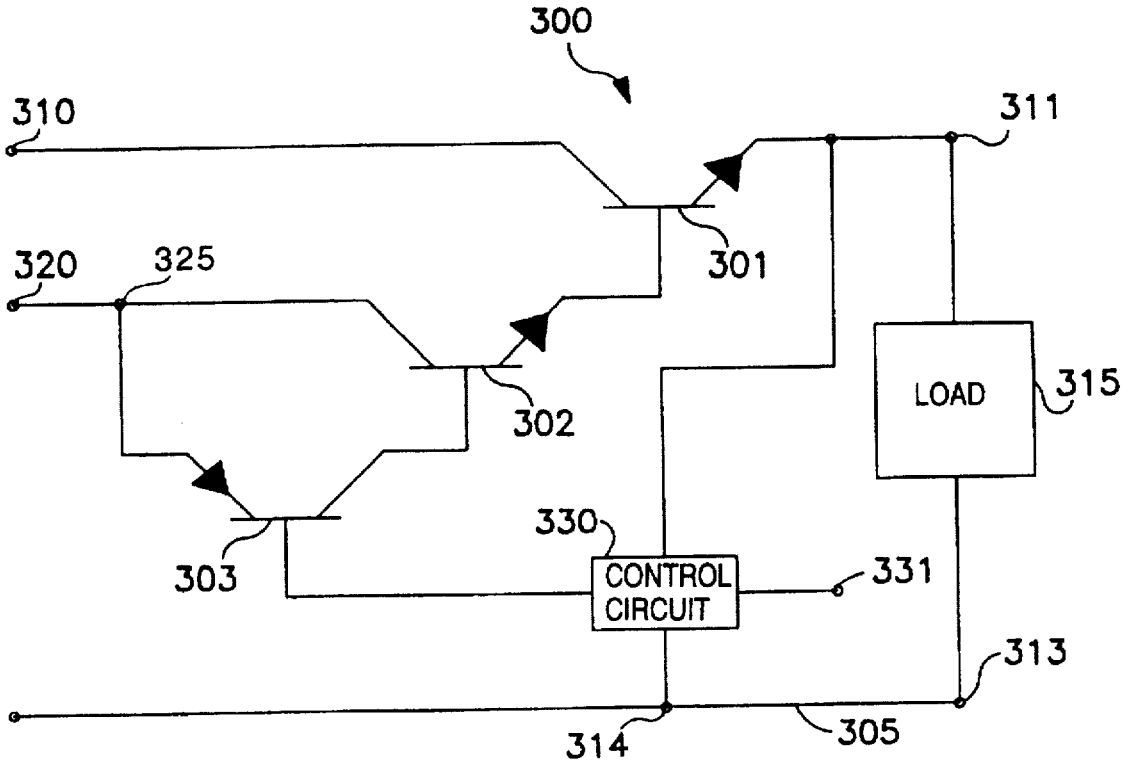
FIG. 3 shows a circuit diagram of an embodiment of an ultra low drop out power regulator of the present invention.

FIG. 3 illustrates a currently preferred embodiment of circuit 300 used in the power regulator of the present invention. Circuit 300 comprises transistors 301, 302, and 303, control circuit 330, inputs 310 and 320, output 311, return connection 314, and output voltage adjust connection 331. In a currently preferred embodiment, input 310 is coupled to, for example, 3.3 V. Also in a currently preferred embodiment, input 320 is coupled to, for example, 5.0 V. As shown, input 310 is coupled to the collector of transistor 301, the emitter of which is coupled to output 311. Input 320 is coupled to the emitter of transistor 303, and the collector of transistor 302.

As shown in FIG. 3, output 311 is coupled to device 315. Device 315 may be any device needing a regulated power supply. For example, output 311 may be coupled to the termination lines of a high speed, low voltage bus of a high speed microprocessor, or any other load needing a dynamically fast and electrically clean supply of power at the point of use.

Note that in circuit 300, the voltage drop through the driver circuitry, $V_{CE303}+V_{BE302}$ is approximately 1.5 V. Thus, with a 5.0 V coupled to input 320, the base of transistor 301 can now be driven with a higher voltage then supplied through input 310. In this way, the power supplied through circuit 300 flows through transistor 301, so that the drop out voltage is equal to $V_{CE201}$, which is approximately 0.25 V. Thus, circuit 300 has a 0.25 V drop out voltage.

Note that the differential between the voltage at input 310 and the output voltage at 311 (i.e. 3.3–2.4 V=0.9 V) is now greater than the 0.25 V drop out voltage, so that an input voltage of 3.3 V can produce a 2.4 V output voltage, even under worse-case conditions. Furthermore, the circuit 300 has an improved efficiency over the regulator 102 of the prior art. For example, with an output of 2.4 V, the prior art regulator 102 efficiency is 2.4 V/5.0 V=48%. In contrast, the efficiency of circuit 300, is 2.4 V/3.3 V=73%. Thus, the present invention has an efficiency improvement of (73–48)

/48=52% over the prior art. In addition, the present invention has an improvement in the operating cost due to lower power loss. For example, if the output current is 10 amps (A), the power loss of the prior art regulator 102 (assuming it could provide 10 A power), under the above described conditions equals (5.0 V−2.4 V)·10 A=26 watts (W). In contrast, the power loss of the present invention is equal to (3.3 V−2.4 V)·10 A=9 W. Thus, the present invention provides for 17 W less power consumption at 10 A current. This results in a power loss cost improvement of approximately 65% over the prior art, and cooling requirements approximately ⅓ that of the prior art. In addition, the power saved results in more power available for the load (device 315), which is particularly helpful for newer logic devices.

Figure 5A:
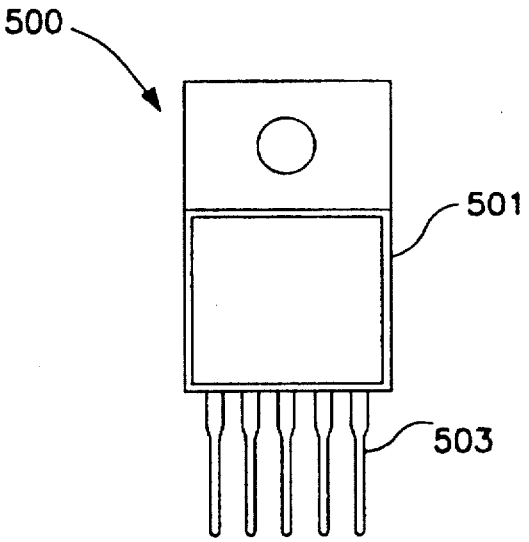
FIG. 5A shows a front view of a package for a voltage regulator in a currently preferred embodiment of the present invention.
Figure 5B:
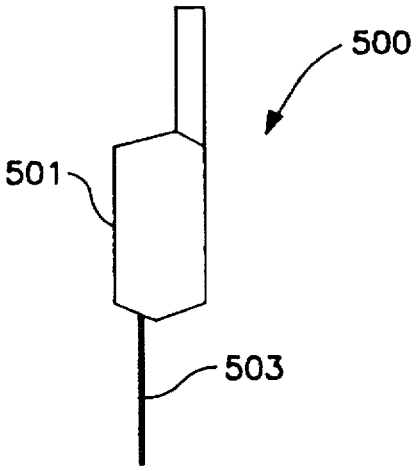
FIG. 5B shows a side view of a package for a voltage regulator in a currently preferred embodiment of the present invention.

Furthermore, the present invention, by virtue of its lowered cooling requirements, can now be placed in a plastic package. Preferably the plastic package is wrapped in a heat sink. FIG. 5A shows a front view of package 500 used in a currently preferred embodiment of the present invention. FIG. 5B shows a side view of package 500. As shown in FIGS. 5A and 5B, package 500 comprises five pins in a currently preferred embodiment. As will be discussed below, the present invention requires at least four pins. As shown, in a preferred embodiment, package 500 is a stand up package (i.e., consumes vertical space), and further is a single in-line package (i.e., all pins in a single line as best seen in FIG. 5B).

Figure 4A:
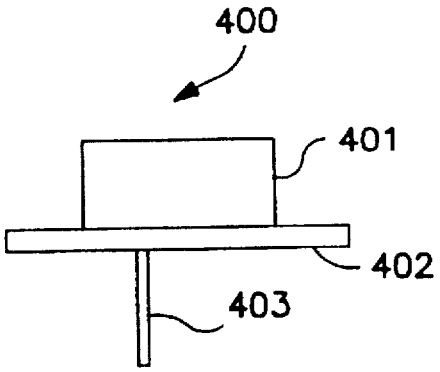
FIG. 4A (PRIOR ART)
FIG. 4A shows a side view of a prior art package.
Figure 4B:
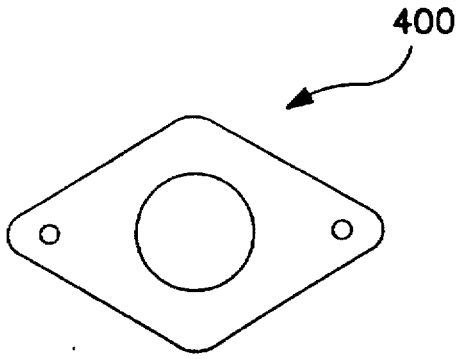
FIG. 4B (PRIOR ART)
FIG. 4B shows a top view of a prior art package.

Currently, for a prior art device dissipating 26 W, a package such as that shown in FIGS. 4A and 4B is required. With heat sinking, the package 400 of FIGS. 4A and 4B consumes approximately 12 cubic inches of volume, and consumes approximately 8 square inches of board footprint. In contrast, with the power regulator of the present invention, utilizing package 500 of FIGS. 5A and 5B, with appropriate heat sinking, the volume consumed is approximately 0.9 cubic inch, and the footprint is approximately 0.6 square inch. In addition, metal package 400 of FIGS. 4A and 4B, for example, the metal TO·3 package described above, is relatively expensive compared with the plastic package in which the present invention may be placed. Furthermore, because the present invention dissipates ⅓ the heat of the prior art, and is in a stand up package which does not block air flow, the device may be placed closer to the load, without adversely affecting the performance of the load.

Additional advantages of the present invention include the fact that because the devices 301, 302, 303, and control circuitry 330 are formed on a single semiconductor chip, i.e. comprise a single part, the device is of higher inherent reliability than prior art solutions using several components. Also, a single part regulator as in the present invention is less expensive than a multiple part solution, and allows for more flexibility. Additionally, since all components are on the same chip in the same package, all are operating at the same temperature, preventing malfunction due to temperature mis-match.

Further, because the present invention is a linear regulator, as compared with a switching regulator, the present invention provides a relatively noise free output, without the need for additional filtering. Additionally, as there is no inductor in the present invention, as needed in a switching regulator, the device is always ready to run and switches from no load to full load faster. Finally, in applications where a capacitor is necessary between output 311 and load 315, the capacitor is typically much smaller than required by a switching regulator.

Referring to FIG. 3, note that the present invention requires at least four pins, one each for input 310, input 320, output 311, and return connection 314. In addition, control circuit 330 which controls the output voltage at output 311 may be made adjustable, if desired. Therefore, a fifth pin 331 may be added, as in the embodiment of FIGS. 5A and 5B to adjust control circuitry 330, if it is desired to provide for an adjustable output voltage 311. If the circuit 300 is used to provide a fixed voltage at output 311, pin 331 is not necessary. Therefore, the present invention may be packaged in a four or five pin package. Of course, any inexpensive, available plastic package, including packages with a greater number of pins, may be used. Preferably a stand up package, and more preferably a single in-line package, is used for the reasons discussed herein. Of course, the present invention is not restricted to these type packages, and, other types of packages, including those such as the metal can described in relation to FIGS. 4A and **4*b*** may be used if further cooling is desired. Furthermore, it will be appreciated that the present invention can be incorporated into other technologies, such as the surface mount technology described earlier, or may be packaged for use in a multi-chip module.

Figure 2:
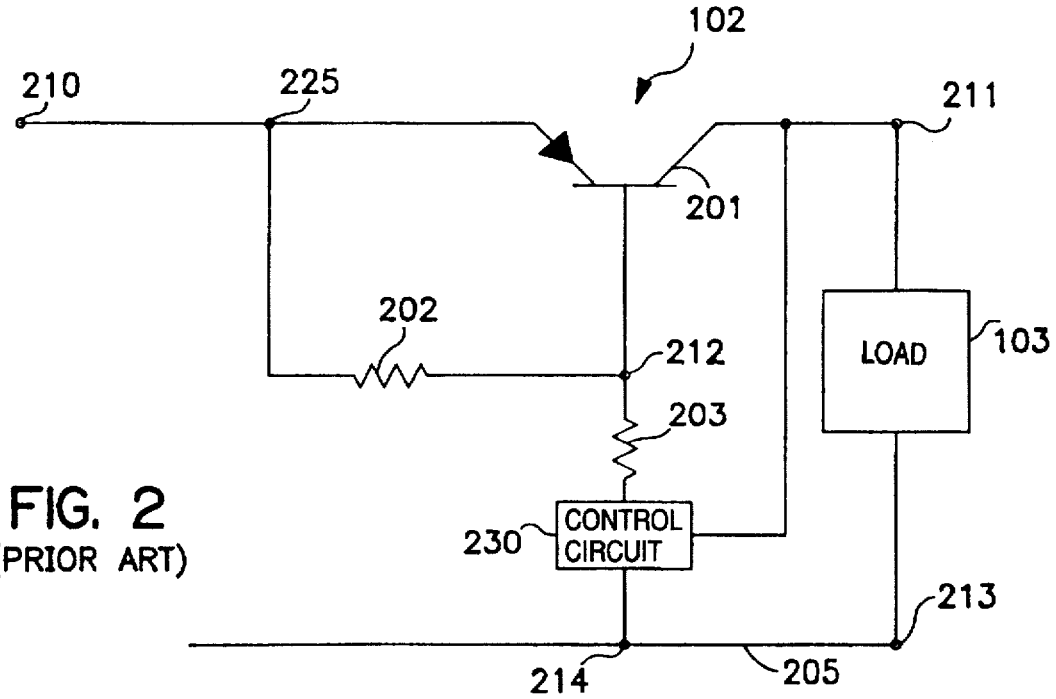
FIG. 2 (PRIOR ART)
FIG. 2 shows a circuit diagram of a prior art low drop out power regulator.

A further benefit of the embodiment of the present invention shown in FIG. 3, is that the drive current flows out to the load. Referring back to FIG. 2, note that drive current flows out the base of transistor 201 and eventually to return 205. Use of pnp transistor 202 loses at least 10% of the power. It is used, however, because it is the best way to reduce heat in a single input circuit. In contrast, in the embodiment of FIG. 3, the drive current flows out of the emitter of npn transistor 302 through the base of transistor 301 and subsequently through the load. In this way, the circuit is more efficient, as this current is not wasted but rather provides a portion of the output current, thereby increasing the overall efficiency from the load's perspective. Furthermore, another advantage with the use of the npn transistor 302, is that since transistor 302 flows in the same direction, if transistor 301 drops out during a transient peak load, transistor 302 can support the transient peak load. In the prior art regulator 102, since the drive current does not flow through the load, it cannot support transistor 201. Additionally, npn transistor 302 inherently provides a higher gain and higher bandwidth than a pnp transistor. Also, an npn transistor operates with low noise and fast response. Further, an npn transistor has an inherently smaller capacitance. From a device physics point of view, npn transistors are superior in overall performance than a pnp equivalent.

Figure 1:
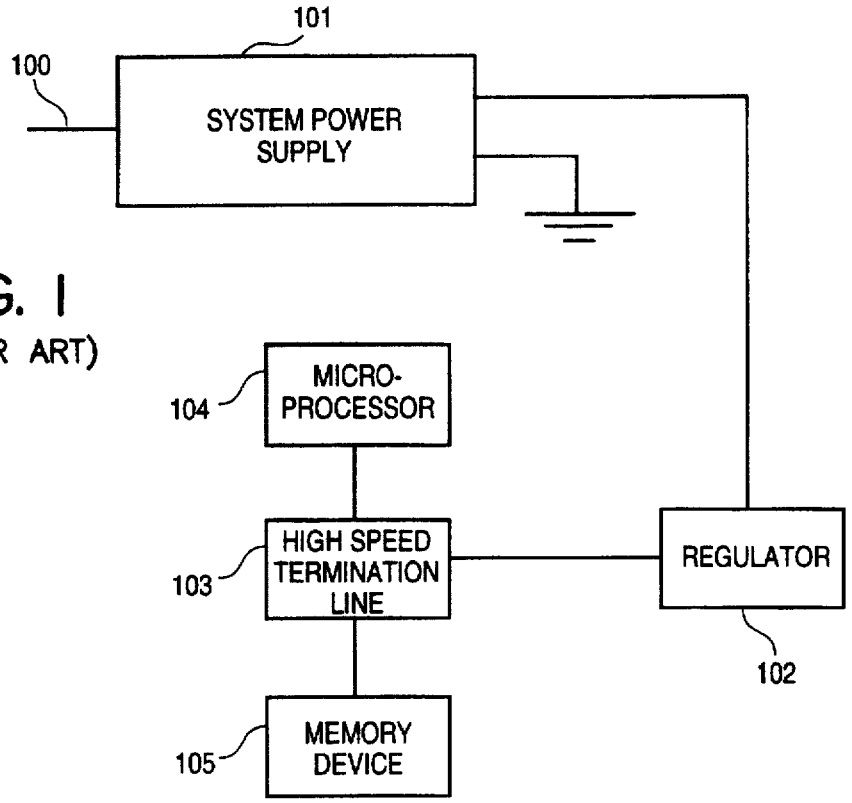
FIG. 1 (PRIOR ART)
FIG. 1 shows a schematic diagram of a portion of a prior art computer system.

Another advantage of the present invention is that it provides built-in or inherent sequencing. For example, referring back to FIG. 1 if microprocessor 104 and 105 are both driven off a 3.3 V input, in the prior art with regulator 102 coupled to a 5.0 V supply, damage to the microprocessor 104 and 105 could occur it the 3.3 V input is disrupted, while the 5.0 V input remains live. In this case, backward conduction could occur, potentially destroying one or both of the devices 104 and 105. In contrast, in the present invention, if the 3.3 V input is lost, the output of the power regulator is derived from this same 3.3 V input, so that termination power is lost simultaneously with the loss of the microprocessor power. In this way, backward conduction prevention is accomplished inherently, without the need for additional circuitry.

Although the present invention has been described with reference to particular embodiments, it will be appreciated that various modifications may be made. For example, voltages other than the input voltages of 3.3 V at input 310, and 5.0 V at input 320 may be used. The embodiment of the present invention shown in FIG. 3 may be practiced with virtually any two input voltages of different values. Further, other devices besides or in addition to the transistors 301, 302, and 303, for example, may be used. In some cases, use of other devices may result in a loss of some of the benefits of the present invention. For example, if a pnp transistor is used for transistor 302, the above described advantages of the drive current flowing through the load, and result in increased efficiency and gain, and support of transistor 301 will be lost. Alternatively, MOS FET's may be used in place of one or more of the disclosed transistors but would require higher voltages to drive, and would not be as fast as the bipolar devices described.

As another example, a further transistor can be used to drive transistor 303, providing further increased gain. Further, other transistors can be added in a similar manner to increase gain, although further increases in gain are smaller than that achieved by virtue of having transistor 303 drive transistor 302, for example. As a further alternative, transistors 302 and 303 can be replaced with a single pnp transistor. Of course, such an embodiment would have a higher heat dissipation than the embodiment shown in FIG. 3.

Figure 6:
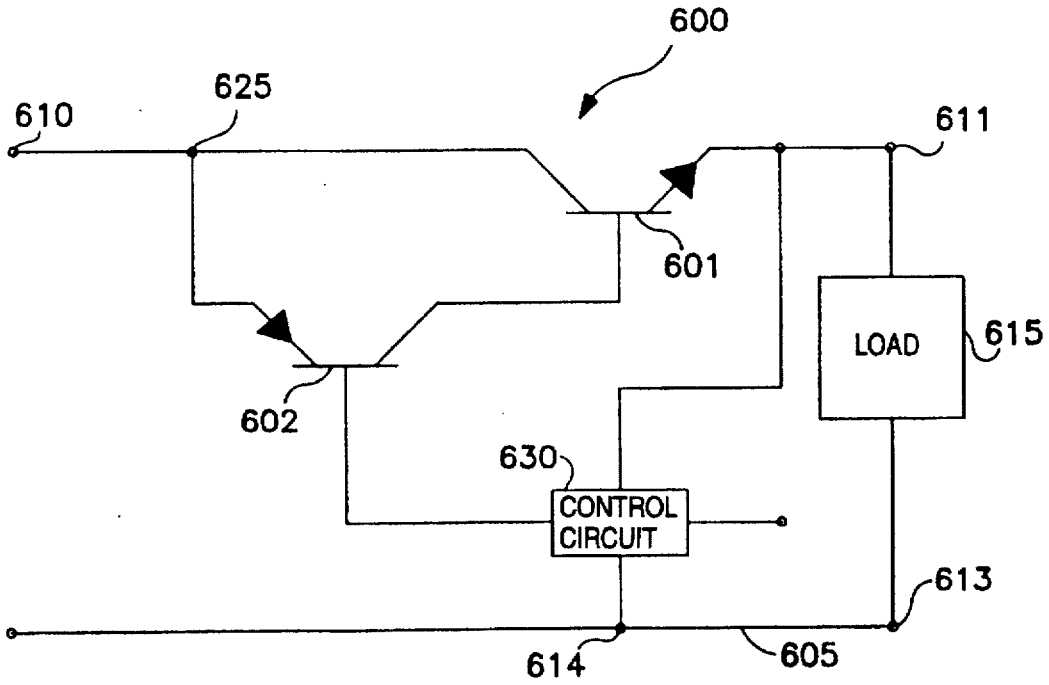
FIG. 6 shows a circuit diagram of an alternative embodiment of the present invention.

FIG. 6 shows a further embodiment of the present invention. In this embodiment, similar reference numerals indicate similar components of earlier Figures such as FIG. 3. As can be seen, the circuit 600 is a single input power regulator. As with the prior art circuit shown in FIG. 2, the circuit 600 of FIG. 6 will not be capable of producing a 2.4 V output with a 3.3 V input. However, in applications where a 5.0 V supply can be used, or in applications where the output at output 611 is sufficiently low to be driven by a 3.3 V input at input 610, and where the excess heat dissipation is not a problem, circuit 600 may be used to provide power for a fast load, such as those described herein.

Thus, an efficient low drop out power supply has been described. Although specific embodiments, including specific equipment, parameters, methods, and materials have been described, various modifications to the disclosed embodiments will be apparent to one of ordinary skill in the art upon reading this disclosure. Therefore, it is to be understood that such embodiments are merely illustrative of and not restrictive on the broad invention and that this invention is not limited to the specific embodiments shown and described.

What is claimed is:

1. A power regulator comprising:

a first input coupled to a first input voltage;

a second input coupled to a second input voltage, said second input voltage greater than said first input voltage; and an output stage having an output, said output stage coupled to said first input, said output stage driven by a driver coupled to said second input.

2. The power regulator as described in claim 1 wherein said output stage comprises a first bipolar transistor.

3. The power regulator as described in claim 2 wherein said first bipolar transistor comprises an npn bipolar transistor, wherein said first input is coupled to a collector of said first transistor, said driver is coupled to a base of said first transistor, and said output is coupled to an emitter of said first transistor.

4. The power regulator as described in claim 2 wherein said driver comprises a second bipolar transistor.

5. The power regulator as described in claim 3 wherein said driver comprises a second bipolar transistor.

6. The power regulator as described in claim 2 wherein said driver comprises a second bipolar transistor and a third bipolar transistor, wherein said second input is coupled in parallel to a collector of said second transistor and an emitter of said third transistor, wherein a collector of said third transistor is coupled to a base of said second transistor, and wherein an emitter of said second transistor is coupled to said base of said first bipolar transistor.

7. The power regulator as described in claim 1 wherein said power regulator is packaged in a single in-line package.

8. The power regulator as described in claim 1 wherein said first input voltage is in the range of approximately 3.1–3.5 V and said second input voltage is in the range of approximately 4.7–5.3 V.

9. The power regulator as described in claim 1 wherein a voltage drop between said first input and said output is approximately 0.6 V or less.

10. The power regulator as described in claim 6 wherein a voltage drop between said first input and said output is approximately 0.6 V or less.

11. A computer system comprising a power regulator, said power regulator comprising:

a first input coupled to a first input voltage;

a second input coupled to a second input voltage, said second input voltage greater than said first voltage;

an output stage having an output, said output stage coupled to said first input, said output stage driven by a driver coupled to said second input; and, a load requiring a high speed, electrically dean power supply, said load coupled to said output.

12. The computer system as described in claim 11 wherein said output stage comprises a first bipolar transistor.

13. The computer system as described in claim 12 wherein said first bipolar transistor comprises an npn bipolar transistor, wherein said first input is coupled to a collector of said first transistor, said driver is coupled to a base of said first transistor, and said output is coupled to an emitter of said first transistor.

14. The computer system as described in claim 12 wherein said driver comprises a second bipolar transistor.

15. The computer system as described in claim 13 wherein said driver comprises a second bipolar transistor.

16. The computer system as described in claim 12 wherein said driver comprises a second bipolar transistor and a third bipolar transistor, wherein said second input is coupled in parallel to a collector of said second transistor and an emitter of said third transistors, wherein a collector of said third transistor is coupled to a base of said second transistor, and wherein an emitter of said second transistor is coupled to said base of said first bipolar transistor.

17. The computer system as described in claim 11 wherein said power regulator is packaged in a single in-line package.

18. The computer system as described in claim 11 wherein said first input voltage is in the range of approximately 3.1–3.5 V and said second input voltage is in the range of approximately 4.7–5.3 V.

19. The computer system as described in claim 11 wherein a voltage drop between said first input and said output is approximately 0.6 V or less.

20. The computer system as described in claim 16 wherein a voltage drop between said first input and said output is approximately 0.6 V or less.

21. The computer system as described in claim 11 wherein said load is a high speed bus termination line.

22. The computer system as described in claim 21 wherein said high speed termination line is a termination line of a microprocessor having a clock speed in the range of approximately 100–400 MHz.

* * * * *